US007003837B2

(12) United States Patent
Pollard et al.

(10) Patent No.: US 7,003,837 B2
(45) Date of Patent: Feb. 28, 2006

(54) BRIDGE CONSTRUCTION SYSTEM

(76) Inventors: Jeff N. Pollard, 1041 Ridgeland Farms Rd., Montgomery, AL (US) 36105; Thomas C. Friday, Hunters Mountain Mobile Estates Lot #206, Troy, AL (US) 36079; Frank H. Murphree, 431 W. College St., Troy, AL (US) 36079

( * ) Notice: Subject to any disclaimer, the term of this patent is extended or adjusted under 35 U.S.C. 154(b) by 53 days.

(21) Appl. No.: 10/879,830

(22) Filed: Jun. 29, 2004

(65) Prior Publication Data

US 2005/0283926 A1 Dec. 29, 2005

(51) Int. Cl.
*E01D 11/00* (2006.01)

(52) U.S. Cl. ..... 14/73; 14/74.5; 14/77.1

(58) Field of Classification Search ..... 14/2, 14/73, 74.5, 77.1, 78
See application file for complete search history.

(56) References Cited

U.S. PATENT DOCUMENTS 1,303,741 A * 5/1919 Thomas ..... 52/87
4,604,841 A * 8/1986 Barnoff et al. ..... 52/174
4,972,537 A 11/1990 Slaw, Sr.
5,025,522 A * 6/1991 Eskew et al. ..... 14/73
5,361,554 A * 11/1994 Bryan ..... 52/480
5,454,128 A 10/1995 Kwon
6,141,927 A * 11/2000 Usui ..... 52/263
6,151,743 A * 11/2000 Church et al. ..... 14/73
6,568,139 B1 5/2003 Bot
6,668,412 B1 12/2003 Tadros et al.

FOREIGN PATENT DOCUMENTS

JP 06313306 A 11/1994
JP 11293626 A 10/1999

* cited by examiner

*Primary Examiner*—Raymond W Addie
(74) *Attorney, Agent, or Firm*—C. Brandon Browning; Sirote & Permutt, P.C.

(57) ABSTRACT

A method of constructing a bridge including forming a concrete slab remote from the bridge, the slab having a side with at least one bolt hole therein, orienting the side of the concrete slab substantially parallel to the side of a girder so that the bolt hole of the concrete slab is aligned with a bolt hole in the side of the girder and connecting the bolt hole of the concrete slab with the bolt hole of the girder using a bracket and a pair of bolts.

21 Claims, 6 Drawing Sheets

BRIDGE CONSTRUCTION SYSTEM

FIELD OF THE INVENTION

This invention relates to a bridge construction method and system. More particularly, this invention relates to a pre-cast concrete bridge webbing and method of securing the webbing to a bridge support structure such as a support beam or a girder.

BACKGROUND OF THE INVENTION

The construction of a bridge can be a protracted undertaking when the support beams or steel girders of the bridge are to be erected on site. That is because in such instances the concrete webbing must be poured in place between the support beams or girders at an elevated height. In addition to being a dangerous undertaking, pouring concrete between the erected beams or girders requires that multiple customized forms, which usually take on the form of wooden boxes, be fashioned on top of the beams or girders for containing and supporting concrete after it is poured. Although forms are often constructed off site to save time and effort, they still must be assembled on site between the erected beams or girders and trimmed to their final dimensions. After the concrete is poured and the webbing has set, the forms must be removed leaving in place the concrete webbing supported by the beams.

The use of prefabricated concrete webbing and decking in the construction of bridges has been suggested as an alternative to using customized forms. For example, in U.S. Pat. No. 4,972,537 to Slaw, Jr., a prefabricated, composite deck panel is disclosed having locking holes arranged throughout the panel and adapted to be fastened to corresponding locking loops that are welded to the top surface of a girder. During bridge construction, the deck panel is placed on top of a girder with the locking holes and corresponding locking loops aligned. A locking bar is subsequently inserted through each locking hole and corresponding locking loop to fix the panel and girders together. Other methods of constructing bridges using pre-cast or pre-fabricated webbing are disclosed in U.S. Pat. No. 5,454,128 to Kwon and U.S. Pat. No. 6,568,139 B2 to Bot.

OBJECTS AND SUMMARY OF THE INVENTION

A primary object of the invention is to provide a quick, cost-effective and safe method of constructing a bridge.

A further primary object of the invention is to provide a method of constructing a bridge section where the support beams of the bridge section are erected on site.

A further primary object of the invention is to provide a pre-cast concrete bridge webbing and method of securing the webbing to an erected bridge support structure such as a support beam or a girder.

A further object of the invention is to provide method of constructing a bridge including providing a pre-cast concrete webbing having a corrugated portion for increasing the surface area of the webbing, a connecting portion for connecting the webbing to a bridge support structure and a supporting portion for directly contacting and resting upon a side of the bridge support structure.

A further object of the invention is to provide method of constructing a bridge including connecting a set of bolts extending from a side of a pre-cast concrete webbing with another set of bolts or threaded rods extending from a side of a bridge support structure.

A further object of the invention is to provide method of constructing a bridge including connecting a set of brackets with and between a pre-cast concrete webbing and a girder.

A further primary object of the invention is to provide an alternative to forming a bridge webbing by pouring concrete between a pair of erected bridge support structures.

A further primary object of the invention is to provide a pre-cast concrete webbing including at least one bolt hole in at least one side thereof that corresponds to a bolt hole or threaded rod in a side of a bridge support structure to which the webbing is intended to be connected.

Another primary object of the invention is to provide a bridge section including a pair of bridge support structures erected on site, a pre-cast concrete webbing suspended between and supported by the pair of bridge support structures and a set of brackets situated between and connected with at least one side of the webbing and at least one of the bridge support structures.

The various objects of the invention are accomplished by providing a bridge construction system including a pre-cast concrete bridge webbing and method of securing the webbing to a bridge support structure. The pre-cast webbing generally includes a concrete slab having at least one protruding connecting member arranged along a side of the webbing that is to be connected with the bridge support structure. Connecting members can include any number of items including for example bolts, screws, bent or straight rods, threaded rods, rivets and the like. The connecting members can be screwed into holes in the slab after it is cast, anchored within the slab when it is formed or set therein by any other means known in the art. Although the arrangement of the connecting members throughout the webbing is dictated by, among other things, the size, shape and weight of the webbing, as well as the type of bridge support structure to which the webbing is to be connected, the connecting members generally are arranged along a pair of opposing sides of the webbing and consist of at least one bolt that extends out from the side of the concrete slab.

In use, the pre-cast webbing is lifted into position next to an erected bridge support structure and oriented with the connecting member of one side of the slab being aligned with a corresponding connecting site along a side of one of the bridge support structures. A connecting site can be identified by any number of means including, for example, a bolt, a screw, a straight or bent rod, a threaded rod, a rivet or the like extending out from the side of the bridge support structure or, alternatively, by a hole or an opening extending partially or completely through the structure. It is anticipated that in some applications that the connecting sites will be fashioned after the webbing has been positioned beside the bridge support structure according to the arrangement of the connecting members of the webbing.

Where the bridge support structure includes a ledge protruding from its side, for example, as is found on a typical girder, the slab can be placed upon the ridge for providing additional support of the slab by the bridge support structure. In such instances, it is beneficial for the slab to include a lip that is arranged to rest upon and be supported by the ridge of the bridge support structure.

Once the pre-cast webbing is properly oriented in relation to the bridge support structure, the connecting member and the corresponding connecting site can be connected to one another by any number of means. For example, the connecting member and corresponding connecting site can be welded, linked, screwed, bolted, strapped or bonded together. Preferably, the connecting member and corresponding connecting site are linked together using a connecting piece such a bracket. More preferably, a U-shaped bracket is used to connect the connecting member with the connecting site.

After the connecting member and the connecting site are joined together, any space that is left between the webbing and the support structure can be filled with a grout such as a cementitious grout. Where the slab includes a lip, the grout is contained within the space by the sides of the slab and bridge support structure. Preferably, the side of the slab includes a series of depressions giving the side of the slab a corrugated pattern across a portion of its surface. The corrugated surface increases the overall surface area of the side thereby increasing the strength of the bond of the grout with the side of the slab.

Other features and objects and advantages of the present invention will become apparent from a reading of the following description, as well as a study of the appended drawings.

DETAILED DESCRIPTION OF PRESENTLY PREFERRED EMBODIMENTS

Figure 1:
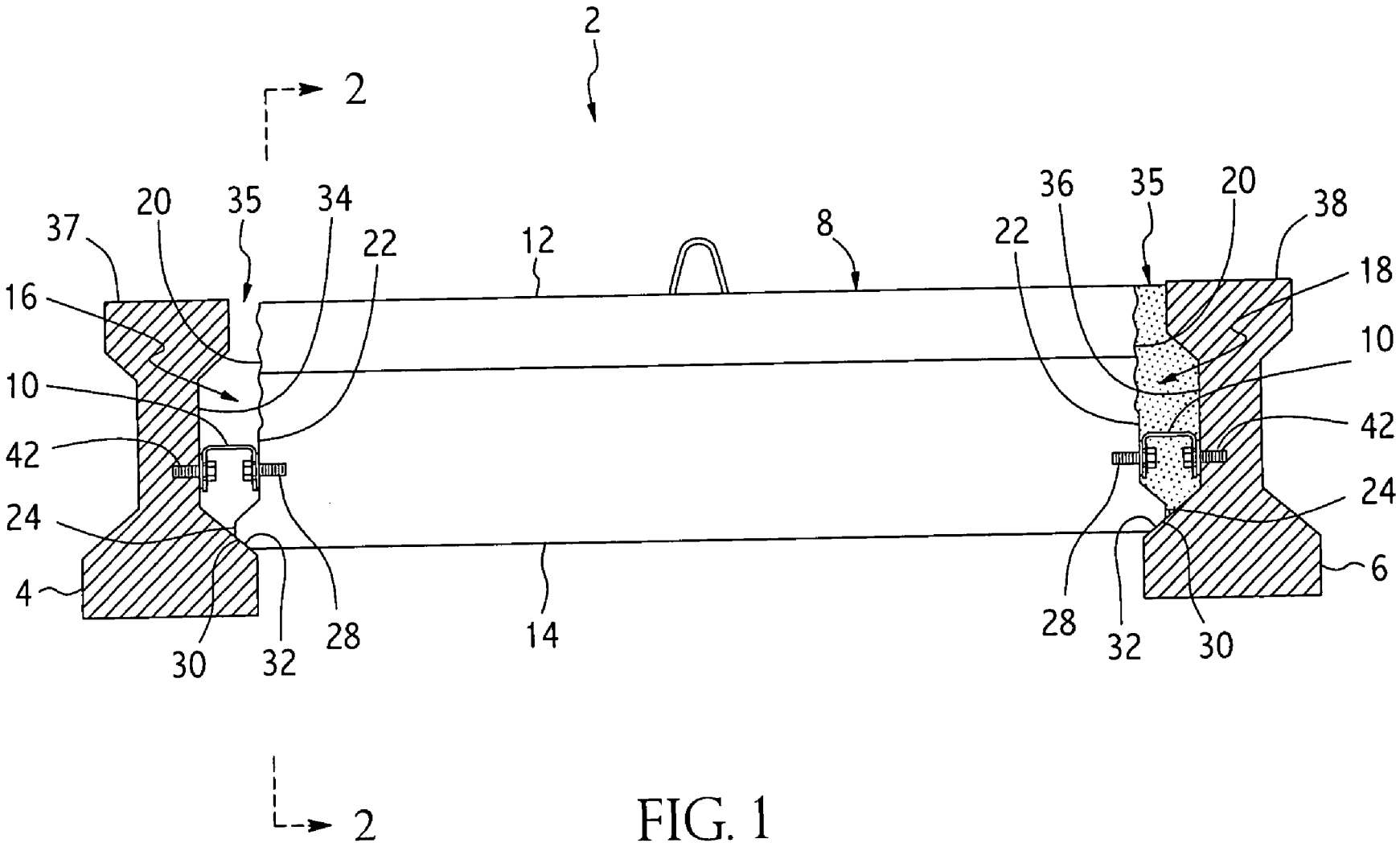
FIG. 1 is a cross-sectional side view of a bridge section in accordance with a preferred embodiment of the present invention.
Figure 2:
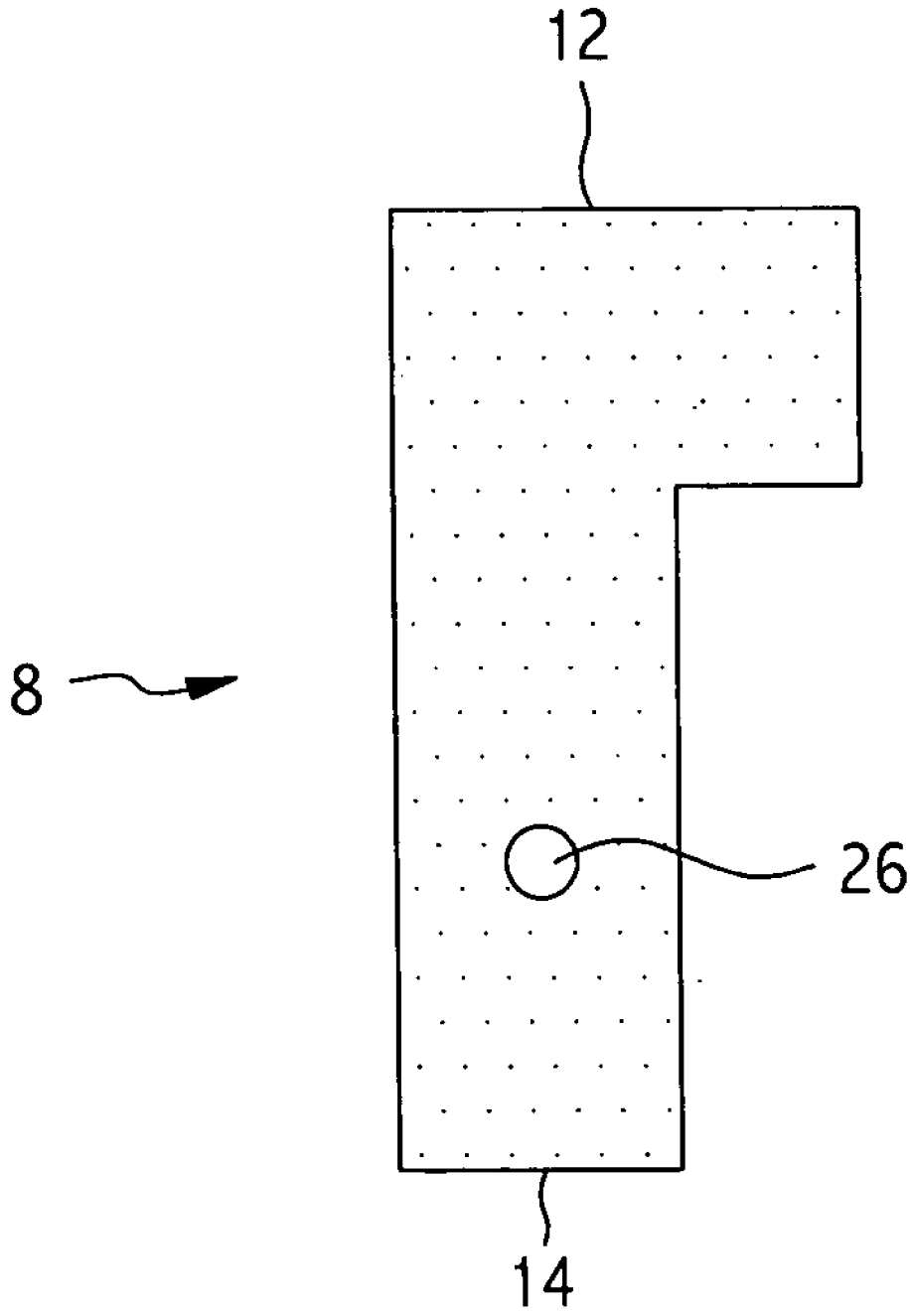
FIG. 2 is a sectional view of the bridge section of FIG. 1 along lines 2—2.
Figure 3:
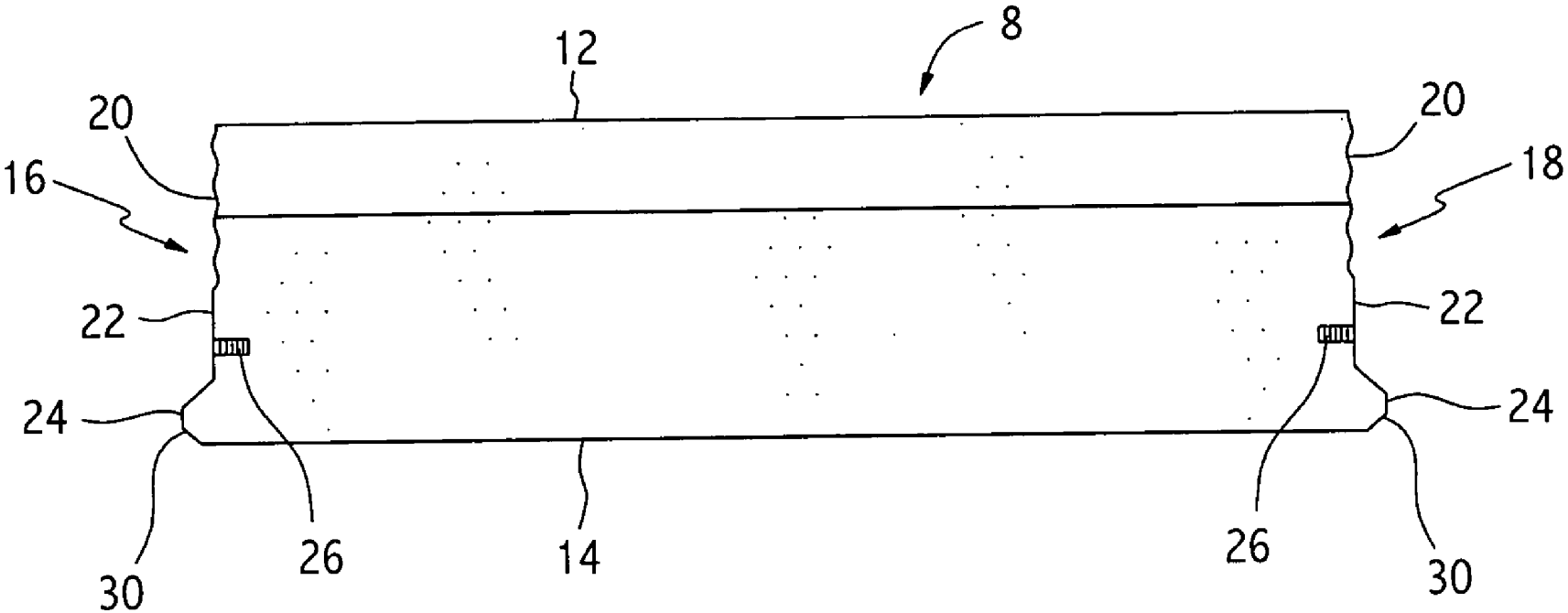
FIG. 3 is a cross-sectional side view of a pre-cast concrete webbing of the bridge section FIG. 1.
Figure 5:
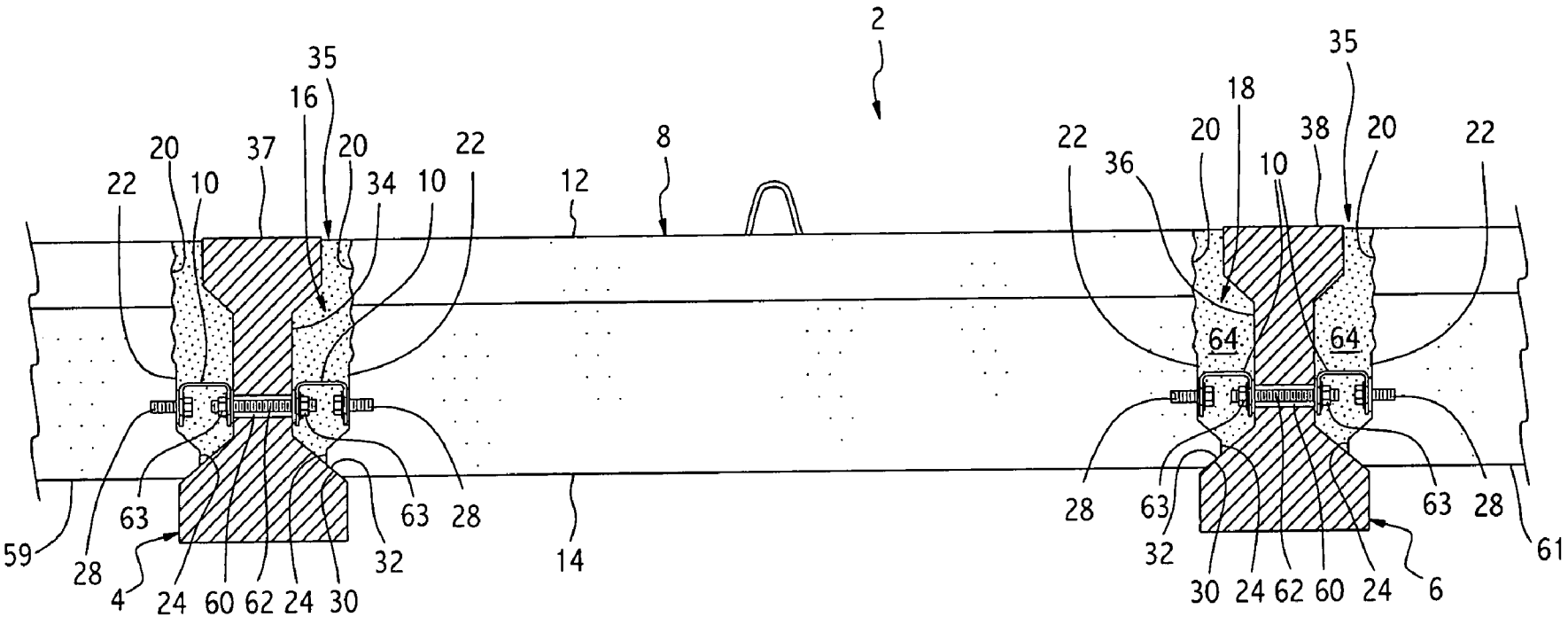
FIG. 5 is a sectional view of a bridge section in accordance with another preferred embodiment of the present invention.
Figure 6:
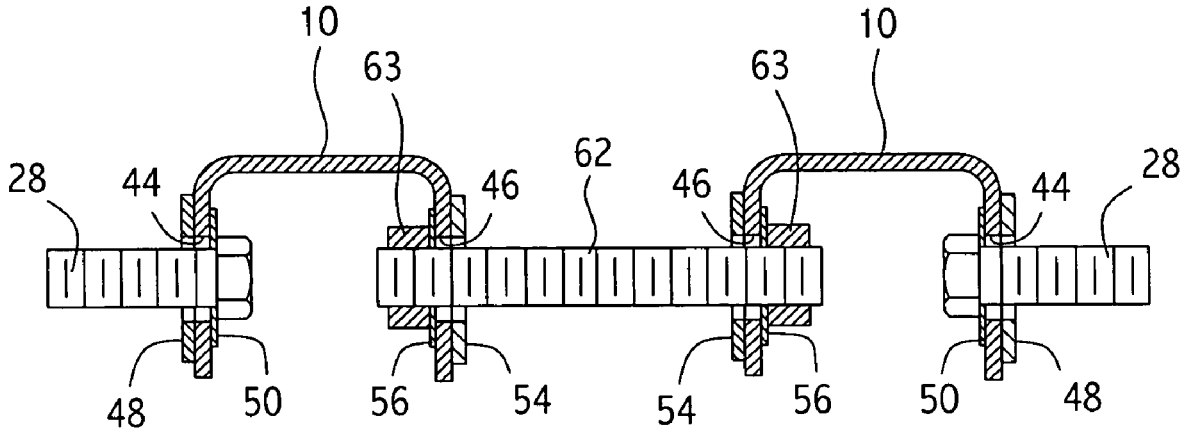
FIG. 6 is a sectional view of a mounting bracket assembly of the bridge section of FIG. 5.

The preferred embodiment of the present invention is illustrated in FIGS. 1–4, where like portions share like numbering. FIGS. 5 and 6 illustrate another preferred embodiment of the present invention, where like portions share like numbering with FIGS. 1–4. As illustrated at FIGS. 1 and 5, a bridge section 2 of the present invention generally includes a first concrete girder 4, a second concrete girder 6 positioned substantially parallel to girder 4, a webbing 8 oriented between girders 4 and 6, and a U-shaped mounting bracket 10 connected between and with webbing 8 and each of girders 4 and 6.

More specifically, webbing 8 comprises a pre-cast, inverted L-shaped, steel reinforced concrete slab having an upper surface 12, a lower surface 14 and opposing lateral sides 16 and 18. Each of opposing lateral sides 16 and 18 is divided into an upper corrugated portion 20 for increasing the surface area of sides 16 and 18, a substantially flat, middle attachment portion 22 having a threaded hole 26 for connecting webbing 8 with a respective one of girders 4 and 6 and a lower support portion 24 for supporting webbing 8 on and between girders 4 and 6. Support portion 24 of each of opposing sides 16 and 18 includes a lip 30 that is adapted to rest upon a ridge 32 formed from the sides of either of girders 4 and 6. Thus, webbing 8 is positioned between girders 4 and 6 such that opposing sides 16 and 18 are oriented substantially parallel to a lateral side 34 of girder 4 and a lateral side 36 of girder 6, respectively, and lip 30 of support portion 24 of each of opposing sides 16 and 18 rests upon ridge 32 of lateral side 34 of girder 4 and ridge 32 of lateral side 36 of girder 6, respectively. The arrangement of webbing 8 between girders 4 and 6, with lip 30 of each opposing sides 16 and 18 upon a respective ridge 32, forms a pocket 35 on both lateral sides 16 and 18 between webbing 8 and girders 4 and 6. Pocket 35 provides an area in which mounting bracket 10 can be placed, as well as a sufficient amount of space within which the manipulation and ultimate securing of mounting bracket 10 to webbing 8 and girders 4 and 6 can be accomplished. As illustrated in FIGS. 1 and 5, the arrangement of webbing 8 between girders 4 and 6, further results in upper surface 12 of webbing 8 being coplanar with a top side 37 and 38 of girders 4 and 6, respectively.

As illustrated in FIG. 1, in order to connect opposing sides 16 and 18 of webbing 8 to girders 4 and 6, each of girders 4 and 6 includes a threaded hole 40 (not shown) formed in lateral sides 34 and 36 thereof, respectively, with each threaded hole 40 (not shown) being adapted to receive and hold firmly therein a threaded, hex head bolt 42. Each threaded hole 40 (not shown) is arranged within a respective one of girders 4 and 6 to correspond with the arrangement of threaded hole 26 of a respective one of opposing sides 16 and 18. Thus, to connect webbing 8 between girders 4 and 6, a threaded, hex head bolt 28 and hex head bolt 42 are securely inserted into attachment portions 22 and each of girders 4 and 6, respectively, and connected by mounting bracket 10.

Figure 4:
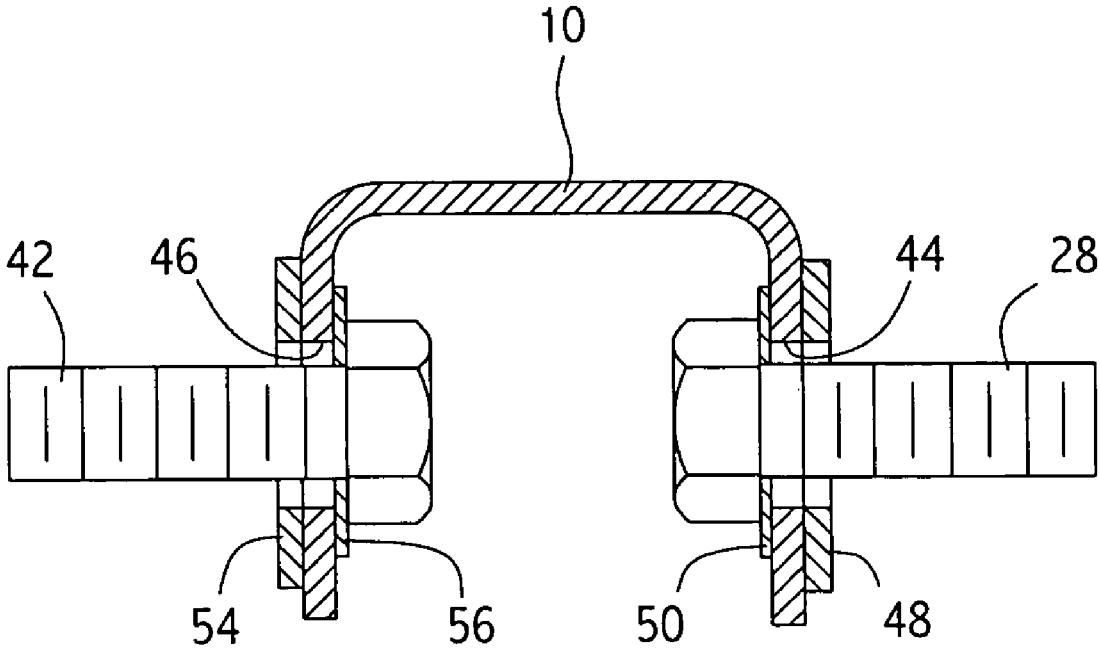
FIG. 4 is a sectional view of a mounting bracket assembly of the bridge section of FIG. 1.

More specifically, as illustrated in FIG. 4, each mounting bracket 10 includes a first opening 44 adapted to connect with hex head bolt 28 and opposite thereto, a second opening 46 adapted to connect with hex head bolt 42. Thus, referring to FIGS. 1 and 4, to connect and support webbing 8 between girders 4 and 6, one hex head bolt 28 is inserted, in the following order, through a first washer 50, first opening 44 of mounting bracket 10, a first shim 48 and finally into threaded hole 26 of lateral side 16 of webbing 8 and secured therein by screwing bolt 28 into hole 26. Likewise, one threaded bolt 42 is inserted, in the following order, through a second washer 56, second opening 46 of mounting bracket 10, a shim 54 and finally into threaded hole 40 (not shown) of lateral side 34 of girder 4 and secured therein by screwing bolt 42 into hole 40 (not shown). This way, lateral side 16 of webbing 8 is connected with girder 4. To connect lateral side 18 of webbing 8 to girder 6, the above-described procedure is merely repeated. To that end, one hex head bolt 28 is inserted, in the following order, through first washer 50, first opening 44 of mounting bracket 10, first shim 48 and finally into threaded hole 26 of lateral side 18 of webbing 8 and secured therein by screwing bolt 28 into hole 26, and one threaded bolt 42 is inserted, in the following order, through second washer 56, second opening 46 of mounting bracket 10, shim 54 and finally into threaded hole 40 (not shown) of lateral side 36 of girder 6 and secured therein by screwing bolt 42 into hole 40 (not shown).

Alternatively, as illustrated in FIGS. 5 and 6, where one or both of girders 4 and 6 is an interior girder such that the girders support other webbings 59 and 61 on each lateral side thereof, another arrangement can be used to connect webbings 8, 59 and 61 to girders 4 and 6. According to this arrangement, each threaded hole 42 of girders 4 and 6 of FIG. 1, is replaced by a continuous hole 60 that extends completely through a respective one of girders 4 and 6 and is adapted to receive and hold firmly therein a threaded rod 62. As best illustrated in FIG. 6, according to this alternate preferred embodiment of the present invention, threaded rod 62 extends through a respective one of girders 4 and 6, is attached at each end thereof to a respective mounting bracket 10 and locked there against with a nut 63, which bracket 10 in turn is connected to a respective one of webbing 59 and 61 by hex head bolt 28 as described above.

Referring to FIGS. 1 and 5, once webbing 8 is positioned and connected between girders 4 and 6, each pocket 35 formed between webbing 8 and girders 4 and 6 is filled in with an amount of cementitious grout 64 to provide a cementitious grout upper surface that is coplanar with top sides 37 and 38 of girders 4 and 6, respectively. Grout 64 is contained within each pocket 35 laterally by opposing sides 16 and 18 of webbing 8 and lateral sides 34 and 36 of girder 4 and 6, respectively and underneath by the intersection of lip 30 and ridge 32 of a respective one of girders 4 and 6. The added surface area provided by corrugated portion 20 of each side 16 and 18 of webbing 8 allows for increased bonding of webbing 8 to girders 4 and 6.

As will be apparent to one skilled in the art, various modifications can be made within the scope of the aforesaid description. Such modifications being within the ability of one skilled in the art form a part of the present invention and are embraced by the claims below.

What is claimed is:

1. A bridge comprising, a first girder via at one bracket assembly with a side forming a first ridge, a second girder via at least bracket assembly with a side forming a first ridge, and a pre-cast concrete slab with opposing sides, wherein one of the opposing sides of the concrete slab is located substantially parallel to and connected with the side of the first girder and another of the opposing sides of the concrete slab is located substantially parallel to and connected with the side of the second girder.

2. The bridge according to claim 1 wherein the concrete slab is in contact with the first ridge of the first girder and the first ridge of the second girder.

3. The bridge according to claim 1 wherein the at least one bracket is connected with the concrete slab by a bolt.

4. The bridge according to claim 1 wherein the at least one bracket is connected with the first girder by a bolt.

5. The bridge according to claim 1 wherein the first girder includes a hole extending from the side of the first girder to a second side of the first girder and wherein the at least one bracket is connected with the side of the first girder by a threaded rod extending out of the hole.

6. The bridge according to claim 1 further comprising a second pre-cast concrete slab with a side wherein the side of the second concrete slab is located substantially parallel to a second side of the first girder and connected therewith by a second bracket.

7. The bridge according to claim 6 wherein the second concrete slab is in contact with a second ridge of the second side of the first girder.

8. The bridge according to claim 6 wherein the first girder includes a hole extending from the side of the first girder to the second side of the first girder and wherein the at least one bracket is connected with the side of the first girder by a threaded rod extending out of the hole and the second side of the first girder is connected with the second bracket by the threaded rod.

9. The bridge according to claim 1 wherein at least one of the opposing sides of the concrete slab includes a corrugated portion.

10. The bridge according to claim 9 wherein the at least one of the opposing sides of the concrete slab includes a lip portion.

11. The bridge according to claim 10 wherein the at least one of the opposing sides of the concrete slab includes a flat portion.

12. A bridge section comprising, a pre-cast concrete slab having a first bolt extending out from one vertical side of the slab and a second bolt extending out from an opposing vertical side of the slab, a first girder having a vertical side with a bolt extending out therefrom, and a second girder having a vertical side with a bolt extending out therefrom, wherein the first bolt of the concrete slab is connected with the bolt of the first girder and the second bolt of the concrete slab is connected with the bolt of the second girder and each of the first bolts is connected with a respective one of the bolts of the first and second girders by a bracket.

13. The bridge section according to claim 12 wherein the bracket is a U-bracket.

14. The bridge section according to claim 12 wherein each of the vertical side and opposing vertical side of the concrete slab includes a corrugated portion.

15. The bridge section according to claim 12 wherein each of the vertical side and the opposing vertical side of the concrete slab includes a flat portion.

16. The bridge section according to claim 12 wherein each of the vertical side and opposing vertical side of the concrete slab includes a lip portion.

17. A method of constructing a bridge section comprising, providing an erected first girder in parallel to an erected second girder, positioning a vertical side of a pre-cast concrete slab parallel to a vertical side of the first girder, positioning an opposing vertical side of the concrete slab parallel to a vertical side of the second girder, attaching the vertical side of the concrete slab to the vertical side of the first girder with a first bracket assembly, and attaching the opposing vertical side of the concrete slab to the vertical side of the second girder with a second bracket assembly.

18. The method according to claim 17 wherein each of the first and the second bracket assemblies includes a bracket and at least one bolt.

19. The bridge section according to claim 17 wherein each of the vertical side and opposing vertical side of the concrete slab includes a corrugated portion.

20. The bridge section according to claim 17 wherein each of the vertical side and the opposing vertical side of the concrete slab includes a flat portion.

21. The bridge section according to claim 17 wherein each of the vertical side and opposing vertical side of the concrete slab includes a lip portion.

* * * * *

UNITED STATES PATENT AND TRADEMARK OFFICE

CERTIFICATE OF CORRECTION

PATENT NO. : 7,003,837 B2
APPLICATION NO. : 10/879830
DATED : February 28, 2006
INVENTOR(S) : Jeff N. Pollard et al.

It is certified that error appears in the above-identified patent and that said Letters Patent is hereby corrected as shown below:

In claim 1, col. 5, line 25, delete "via at one bracket assembly"
In claim 1, col. 5, line 27, delete "via at least bracket assembly"
In claim 1, col. 5, line 32, after "first girder" insert --via at least one bracket assembly--
In claim 1, col. 5, line 34, after "second girder" insert --via at least one bracket assembly--
In claim 3, col. 5, line 39, after "bracket" insert --assembly--
In claim 4, col. 5, line 41, after "bracket" insert --assembly--
In claim 5, col. 5, line 45, after "bracket" insert --assembly--
In claim 12, col. 6, line 21, after "each of the first" insert --and second--

Signed and Sealed this

Fifteenth Day of August, 2006

JON W. DUDAS
*Director of the United States Patent and Trademark Office*